US005299419A

United States Patent [19]

Bittle et al.

[11] Patent Number: 5,299,419

[45] Date of Patent: Apr. 5, 1994

[54] GAS FLOW HEADERS FOR INTERNAL COMBUSTION ENGINES

[76] Inventors: James J. Bittle, 4420 Jutland Dr., San Diego, Calif. 92117; Michael A. Salyer, 8713 Hebrides Dr., San Diego, Calif. 92126

[21] Appl. No.: 970,007

[22] Filed: Nov. 2, 1992

[51] Int. Cl.[5] ..... F01N 7/10

[52] U.S. Cl. ..... 60/313; 60/323

[58] Field of Search ..... 60/313, 323

[56] References Cited

U.S. PATENT DOCUMENTS 3,491,534 1/1970 Garner ..... 60/313
4,621,494 11/1986 Fujita ..... 60/313
4,796,426 1/1989 Feuling ..... 60/313

*Primary Examiner*—Douglas Hart
*Attorney, Agent, or Firm*—Thomas Fitting

[57] ABSTRACT

An exhaust header system for an internal combustion engine having improved exhaust gas flow characteristics. Primary pipes extend from openings in a flange bolted to the engines exhaust ports. The primary pipes come together at a collector pipe into which the primary pipes extend slightly. The ends of the primary pipes are substantially parallel, uniformly spaced around the collector pipe axis and have end surfaces lying substantially in a single plane. A generally pyramidal transition piece has a base corresponding to, and secured to, the primary pile end surfaces so as to cover the area between the pipe ends. The pyramid apex extends along the collector pipe centerline toward the exit end. The length and cross section of the transition piece is selected to provide a smooth transition from the greater combined internal cross section of the primary pipe ends to the lesser cross section of the collector pipe exit end.

8 Claims, 2 Drawing Sheets

GAS FLOW HEADERS FOR INTERNAL COMBUSTION ENGINES

TECHNICAL FIELD OF THE INVENTION

The present invention relates to an improved exhaust header for an internal combustion engine having an improved transition from primary pipes to a collector pipe for improving exhaust gas flow through the header.

BACKGROUND OF THE INVENTION

A wide variety of header systems have been developed for exhausting combustion gases from the cylinders of internal combustion engines and directing the gases to an exhaust pipe in order to improve horsepower, vary the maximum torque band and improve fuel efficiency of the engine. Basically, a header includes a flange plate that bolts up to the engine's exhaust ports, primary tubes that extend from holes in the flange plate at the exhaust port locations to a collector tube which collects the exhaust and directs it into the exhaust pipe having a muffler, catalytic converter, etc.

In the past, automobile manufacturers have provided cast iron header manifolds because they are easier to manufacture and emit less noise. However, these header systems provided less than ideal emission control and gas milage, so that tube-type headers are now provided on many new production cars. After market tube-type headers have long been offered both for improving street performance and for racing.

A variety of header designs have been developed. The most common is the 4-into-1 design in which four primary tubes from the flange to a collector or transition pipe where the total cross sectional area of the primary pipes is collected and reduced to the cross section of the exhaust pipe. In other designs, pairs of primary pipes are brought together, then the combined primaries are brought together in a collector. In pure race cars, the primary pipes from the flanges may be brought outside the vehicle independently, functioning as individual exhaust pipes. In other designs, primary pipes from opposite banks of a V-8 or V-6 engine may be brought together in a selected configuration.

Each of the header components has an effect on performance. For example, using a smaller primary tube diameter tends to lower the torque peak, which is advantageous in a street vehicle but not in a full race car. Longer primary tubes also increase low-end torque, as will a larger collector. Equal length primary pipes assure that each cylinder is scavenged equally. Uniform flow and avoidance of turbulence in the primary pipe, collector and exhaust system are important in reducing back pressure and maximizing both power and fuel efficiency.

The point where the primary pipes come together and enter the collector has been found to be a problem area in assuring smooth, non-turbulent exhaust gas flow through the collector. The cross sectional area of the combined primary pipe ends transitions through the collector to the (generally smaller) exhaust pipe cross section. The cross sectional area that is formed between the bundled primary pipe ends, approximately square with four primary pipes and approximately triangular with three primary pipes, is a major cause of turbulence.

Attempts have been made to smooth this transition by cutting back the adjacent surfaces of adjacent primary pipes, then welding them together to substantially eliminate the area between the pipe ends. This is difficult, expensive in design and manufacture, and with a number of complex welds may actually add to turbulence in this transition region.

Thus, there is a continuing need for improvements in header design to reduce or eliminate turbulence caused by the joining of adjacent primary pipes at the collector and transitioning to the exhaust pipe diameter.

SUMMARY OF THE INVENTION

The above-noted problems, and others, are overcome in accordance with this invention by an exhaust system for an internal combustion engine which basically includes a plurality of primary pipes, each extending from one of the cylinders to an end at a collector pipe, the ends of the pipes being in contact, substantially parallel and uniformly arranged about a central axis and lying substantially in a single plane, and a transition piece having a generally pyramidal shape with the base covering the areas between the adjacent primary pipe ends. Where four primary pipes are brought together, as would be the case with one bank of a V-8 engine, the base of the pyramidal transition piece would be approximately square, while with the three primary pipes of one bank of a V-6 engine, the base would be approximately triangular. While straight-sided bases are generally effective, if desired for optimum performance, the base edges are preferably slightly concave to more precisely match the edges of the primary pipes. Also, the pyramid base will approximate a square or rectangle where four primary pipes are brought together, and will approximate a triangle where three primary pipes are brought together. Other configurations are used where other numbers of pipes are brought together, as is apparent to one skilled in the art.

The pyramidal transition pieces may have any suitable height. A height substantially equal to the length of one side of the base has been found to be effective and can easily be installed in the collector, even with a very compact system. In some cases optimum results are obtained where the height of the pyramid is sufficient to extend to the end of the collector, to provide the most uniform, smooth, transition from the greater total cross sectional area of the combined primary pipe ends to the lesser cross sectional area of the exhaust system. That change in area is known to promote exhaust system efficiency. Depending upon the collector pipe configuration, optimally the sides of the pyramidal transition piece may be slightly concave or convex (along a line taken through the center of a side surface from tip to base) to aid in providing precisely uniform flow cross sectional area reduction through the collector.

The transition pieces may be formed from any suitable material. In general, it is preferred that the material be the same as that of the primary pipes, typically 1010 or 1020 carbon steel, 308 or 321 stainless steel, etc. The transition pieces may be manufactured in any suitable manner. Typically, they may be cast from the appropriate metal or machined from solid stock to final dimensions. In a method that is preferred for low cost and ease of manufacture, two pieces, each making up two adjacent sides of the pyramid, are formed by stamping from heavy sheet metal. The pieces are then joined by welding. This requires only simple and inexpensive tooling, and permits easy production of pyramids with concave base edges and/or concave or convex sides if desired.

BRIEF DESCRIPTION OF THE DRAWING

Details of the invention, and of certain preferred embodiments thereof, will be further understood upon reference to the drawing, wherein.

DETAILED DESCRIPTION OF PREFERRED EMBODIMENTS

Figure 1:
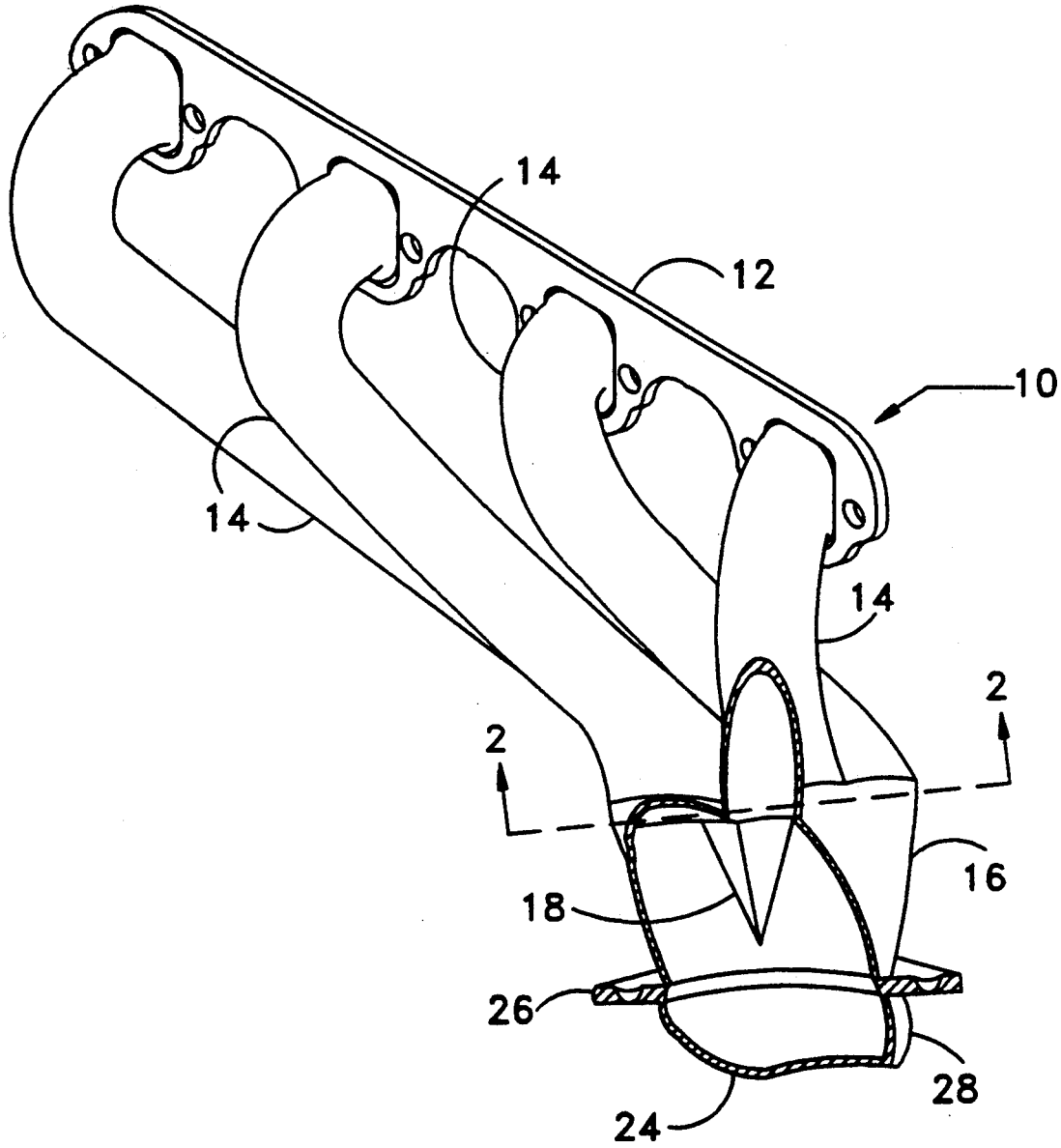
FIG. 1 is a perspective view of the header of this invention, partially cut-away to reveal the transition piece.

Referring now to FIG. 1, there is seen a header 10 of the sort useful with a V-8 engine having four exhaust ports on each bank of four cylinders. A flange 12 bolts to the exhaust ports of a conventional engine with four holes (not seen) located in juxtaposition to the engine exhaust ports. Four primary pipes 14 extend from flange 12 at the hole locations to a collector 16. In the case of a V-6 engine, there will be three primary pipes 14.

Collector 16 has a multi-lobed entrance area, fitting closely around the primary pipe end region and secured thereto, such as by welding. Collector 16 transitions from a larger cross section corresponding to the combined cross-sections of pipes 14 and central area 22 to a lesser cross section at the collector exit 24. Typically, exit 24 includes a flange 26 for bolting to a conventional exhaust pipe (not shown, for clarity) with a conventional spherical connection 28 for sealing to the exhaust pipe.

Figure 2:
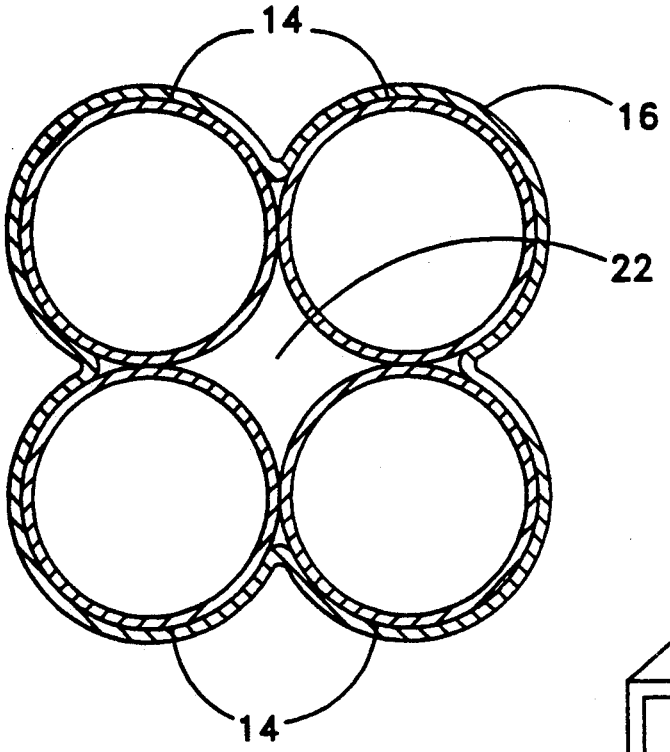
FIG. 2 is a section view taken on line 2—2 in FIG. 1.

Primary pipes 14 preferably have equal lengths and are smoothly curved toward collector 16. The ends of primary pipes 14 are arranged uniformly about a central point, so that there is an opening left between the pipes having a generally square shape, with somewhat concave walls as seen in FIG. 2. The end portions of pipes 14 are substantially parallel and the ends lie substantially in a plane.

A generally pyramidal transition piece 18 having an approximately square base 20 is secured such as by welding base 20 to primary pipes 14 covering the central area 22 between the pipes. Base 20 may be square in the case of four primary pipes 14 or an equilateral triangle in the case of three primary pipes 14. If desired, the sides of base 20 may be slightly concave as seen in FIG. 3 to more precisely correspond to the portions of tubes 16 that form the boundaries of area 22 as seen in FIG. 2.

Figure 4:
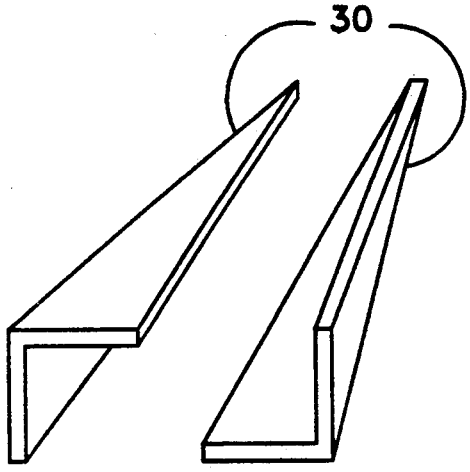
FIG. 4 is a perspective view of a two-part transition piece.

While transition piece 18 may be formed in one piece, such as by casting or machining from solid stock, it can also be built up from piece parts. In one preferred arrangement, as seen in FIG. 4, two halves 30 of a pyramidal shell may be formed by press forming or the like, then welded together and to the primary pipe ends. Since the forming tooling is inexpensive, transition pieces of different sizes for different purposes may be easily made. Further, where concave base sides and/or concave or convex sides are desired, such shapes can be easily provided during the press forming operation.

Figure 3:
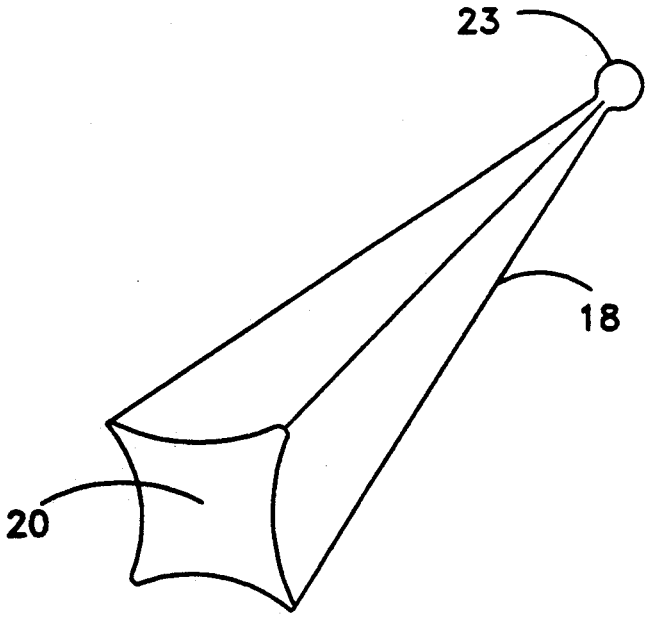
FIG. 3 is a perspective view of a transition piece.

We have also found that in many cases exhaust gas flow can be improved by the provision of a small, ball-like protuberance 22 at the apex of the transition piece, as shown in FIG. 3. Optimum size of protuberance 22 will depend on the length and base diameter of the transition piece. In general, a protuberance having a cross-section of up to about 10% of the cross section of base 20 improves performance. Protuberance 22 may have any suitable shape, typically approximately spherical, elliptical or tear drop shaped, with the cross section in a plane perpendicular to the axis of the transition piece being substantially circular.

Transition piece 18 may have any suitable length. In general a length between a length equal to the length of a base side and a length equal to the length of collector 16 gives best results. Tests have shown improvements in both engine horsepower produced and fuel efficiency when a header using a transition piece according to this invention is used, when compared to the same header without the transition piece.

A particularly preferred embodiment of the present invention uses a modified and shortened header (or shorty header) having a transition piece as defined herein. A shorty header is approximately one third the length of a typical and conventional header such that the primary tube length from head to collector is an average of about 12 inches rather than the typical 36 inches found on conventional headers. The header in FIG. 1 is such a shortened header. A shortened header provides increased horsepower, but contains greater turbulence in the collector region when compared to conventional headers. It is believed that the increased air flow turbulence arises because the shorty header does not have the longer directional air flow passage found in the conventional headers, and because the air is typically hotter, and therefore inherently more turbulent, than the air in a conventional header at the collector point because there is less distance and attendant opportunity for air cooling.

It was found that the present invention was particularly preferred at increasing engine performance in shorty headers.

Engine horsepower (hp) was measured on various headers using an engine dynomometer to determine the effect of the present invention on engine performance. When a transition piece was utilized according to the present invention on a conventional header collecting four primary pipes from a V-8 engine, an increase of about 2 to 5 hp was observed over the conventional header without a transition piece, depending upon other performance factors such as displacement, carburetion, primary pipe diameter, and the like performance variables. When a transition piece was utilized on a shorty header as shown in FIG. 1, an increase of about 10 to 15 hp was observed over the performance of the same shorty header lacking the transition piece according to the present invention. Again, the variation in increased performance depended upon the other listed performance factors.

Thus, the present invention provides a exhaust system having directional device in the form of the transition piece in a header as described herein that improves (streamlines) airflow when the air transitions from a large area source to a small area, in particular where that transition is over a relatively short distance. The improved airflow results in reduced turbulence, increased scavenging and substantial gains in horsepower.

Other applications, variations and ramifications of this invention will occur to those skilled in the art upon reading this disclosure. Those are intended to be included within the scope of this invention, as defined in the appended claims.

We claim:

1. An exhaust system for an internal combustion engine which comprises:

a flange adapted to be secured to exhaust ports of an internal combustion engine;

a plurality of openings through said flange, each adapted to align with an engine exhaust port;

primary pipes secured at their first ends to said flange at said openings;

a collector pipe surrounding the second ends of said primary pipes;

a second ends of said primary pipes lying substantially parallel and in contact with each other, substantially equally spaced around the collector pipe centerline and having end surfaces substantially in a single plane;

a transition piece having an essentially pyramidal shape, the base of said pyramid covering the area between the primary pipe ends and secured to said primary pipe end surfaces, said transition piece having a generally ball-shaped protuberance at the apex of said pyramidal shape;

said collector pipe having an entrance internal cross section at said primary pipe ends substantially equal to the combined internal cross sections of said primary pipe ends;

said collector pipe gradually reducing in internal cross section over its length; and means at the exit of said collector pipe for connection to an exhaust pipe.

2. The exhaust system according to claim 1 wherein said protuberance has a substantially circular cross section in a plane perpendicular to the axis of said pyramidal shape and that cross section has an area up to about 10% of the area of the base of said pyramidal shape.

3. An exhaust gas collection system for use with an internal combustion engine which comprises:

a plurality of primary pipes, each adapted to carry exhaust gas from an engine cylinder;

the output ends of said pipes being located substantially parallel and in contact with each other, substantially equally spaced around a center line and having output end surfaces lying substantially in a single plane;

a collector pipe surrounding said output ends and gradually reducing in cross section away from said ends;

a transition piece having an essentially pyramidal shape, the base of said pyramid covering the area between said primary pipe ends and secured to said output end surfaces;

said base having concave sides corresponding in shape to the shapes of the portions of said output ends surrounding the area between pipe ends; and a generally ball-shaped protuberance at the apex of said pyramid.

4. The exhaust gas collection system according to claim 3 wherein three primary pipes are provided and the central area between pipe ends has an approximately equilateral triangular shape.

5. The exhaust gas collection system according to claim 4 wherein said transition piece has a triangular base secured to the portions of said primary pipes surrounding said central area.

6. The exhaust gas collection system according to claim 3 wherein the length and cross section of said transition piece along its length is sufficient to maintain the internal cross-section of said collector pipe over its length equal to or less than the combined internal cross sections of said primary pipe ends.

7. The exhaust gas collection system according to claim 3 wherein the length of said transition is from a length substantially equal to the length of one side of said base and to a length substantially equal to the length of said collector pipe between the plane of said primary pipe end surfaces and the exit end of said collector pipe.

8. The exhaust gas collection system according to claim 3 wherein said protuberance has a substantially circular cross section in a plane perpendicular to the axis of said pyramidal shape and that cross section has an area up to about 10% of the area of the base of said pyramidal shape.

* * * * *